US008940469B2

(12) United States Patent
Teishev et al.

(10) Patent No.: US 8,940,469 B2
(45) Date of Patent: Jan. 27, 2015

(54) LIQUID DEVELOPER WITH AN INCOMPATIBLE ADDITIVE

(75) Inventors: Albert Teishev, Rishon le-zion (IL); Stalla Stolin Rodith, Rehovot Rehovot (IL); Michael Shishkin, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1682 days.

(21) Appl. No.: 12/445,459

(22) PCT Filed: Oct. 13, 2006

(86) PCT No.: PCT/US2006/040105

§ 371 (c)(1),
(2), (4) Date: Oct. 15, 2009

(87) PCT Pub. No.: WO2008/045085

PCT Pub. Date: Apr. 17, 2008

(65) Prior Publication Data

US 2010/0047700 A1 Feb. 25, 2010

(51) Int. Cl.

| | |
|---|---|
| ***G03G 9/13*** | (2006.01) |
| ***G03G 9/125*** | (2006.01) |
| ***G03G 9/135*** | (2006.01) |

(52) U.S. Cl.

CPC ..... *G03G 9/1355* (2013.01); *G03G 9/131* (2013.01)

USPC ..... 430/114; 430/112; 430/116; 430/137.19

(58) Field of Classification Search

USPC ..... 430/112, 114, 116, 137.19

See application file for complete search history.

(56) References Cited

U.S. PATENT DOCUMENTS

| | | | | |
|---|---|---|---|---|
| 4,476,210 | A * | 10/1984 | Croucher et al. | 430/114 |
| 5,409,796 | A * | 4/1995 | Fuller et al. | 430/115 |
| 5,411,834 | A | 5/1995 | Fuller | |
| 5,856,407 | A | 1/1999 | Chupka | |
| 6,905,807 | B2 * | 6/2005 | Morrison et al. | 430/114 |
| 7,052,816 | B2 | 5/2006 | Qian et al. | |
| 2005/0048391 | A1 * | 3/2005 | Lelental et al. | 430/124 |

FOREIGN PATENT DOCUMENTS

| | | |
|---|---|---|
| JP | 52-090947 A | 7/1977 |
| JP | 1989-044955 | 2/1989 |
| JP | 1991-063665 | 3/1991 |
| JP | 1994-043699 | 2/1994 |
| JP | 1999-505862 | 5/1999 |
| JP | 2004-213018 | 7/2004 |

OTHER PUBLICATIONS

Notice on the First Office Action from the State Intellectual Property Office of the People's Republic of China, dated Mar. 2, 2011, 6 page Chinese version and English translation (3 pages) for counterpart PCT App. No. PCT/US06/40105 in China for the above-referenced U.S. Appl. No. 12/445,459.

(Continued)

*Primary Examiner* — Jonathan Jelsma

(57) ABSTRACT

A liquid developer for electrography, comprising toner particles dispersed in a liquid carrier, wherein the toner particles include a pigment, a thermoplastic resin, and an organic filler, which organic filler is reactive with groups of the thermoplastic resin and incompatible with the liquid carrier.

15 Claims, 2 Drawing Sheets

(56) References Cited

OTHER PUBLICATIONS

Official Office Action by JPO for counterpart Japan patent application No. 2009-532,334, English Translation, dated Jul. 31, 2012 (4 pages).
Chronic Toxicity Summary of Maleic Anhydride (CAS Registry No. 108-31-6), Determination of Noncancer Chronic Reference Exposure Levels Batch 2B, Dec. 2001, pp. A-65 to A-70 (Identified in Response/Amendment dated Sep. 7, 2012 and filed herewith).
Japan Patent Office (JPO) 'Notification of Reasons for Rejection' (translation to English) for counterpart patent application in Japan, dated Apr. 9, 2013 (3 pages).
List of References Cited by JPO with 'Notification' for counterpart patent application in Japan, 1 page.

* cited by examiner

LIQUID DEVELOPER WITH AN INCOMPATIBLE ADDITIVE

FIELD OF THE INVENTION

The invention relates to liquid developers for liquid electrography, compositions thereof, and methods for their preparation.

BACKGROUND OF THE INVENTION

In many printing systems, it is common practice to develop a hardcopy of an image using a photoconductive surface. The photoconductive surface is selectively charged with a latent electrostatic image having image and background areas. A liquid developer comprising charged toner particles in a carrier liquid is brought into contact with the selectively charged photoconductive surface. The charged toner particles adhere to the image areas of the latent image while the background areas remain clean. A hardcopy material (e.g. paper) is brought directly or indirectly into contact with the photoconductive surface in order to transfer the latent image. Variations of this method utilize different ways for forming the electrostatic latent image on a photoreceptor or on a dielectric material.

Typically the liquid developer (often referred to in the art as ink or toner) comprises a thermoplastic resin (polymer) as the basis for the toner particles (also referred to as ink particles), and a non-polar liquid as a carrier liquid in which the toner particles are dispersed. Generally, the toner particles contain a colorant such as a pigment.

Two characteristics of a liquid developer are relevant to the background of the invention. These are the cohesion and the adhesion of the developer. Cohesion is the attraction exerted between the particles of the developer to keep it united throughout its mass. Adhesion is the attraction exerted between the surfaces of the toner particles after development and the surface on which they are fixed, such as the surface of the printed substrate.

Suitable additives may improve many characteristics of liquid toners. For instance, WO 96/17277 the disclosure of which is incorporated herein by reference, discloses that scuff resistance, abrasion resistance, and peel resistance of a wide class of liquid toners may be improved by the addition of a minor amount of an additional material, which at the fusing temperature used for the toner, has a much lower viscosity than the viscosity of the toner particles at the same temperature, and which forms a separate phase from the toner particles when solidified.

U.S. Pat. No. 5,055,370 discloses that a positively chargeable liquid developer having "excellent adhesiveness" may be obtained with toner particles comprising a resin which is prepared by copolymerizing monomers of three specific families; and adds that as for the copolymers containing as a copolymerizing component an acid anhydride group-containing monomer, a copolymer of styrene and maleic anhydride is preferred.

U.S. Pat. No. 5,411,834 teaches liquid developer compositions, having thermoplastic resin particles, optional pigments, a charge director, and an insoluble charge adjuvant. The charge adjuvant is comprised of a copolymer of an alkene and an unsaturated acid derivative, and the acid derivative contains pendant fluoroalkyl or pendant fluoroaryl groups. The charge adjuvant is associated with or combined with the resin and the optional pigment.

JP 1044955 teaches improving fixability of a liquid developer by dispersing in the liquid carrier a specific acrylic resin having a thermosetting functional group and a curable cross-linking agent that does not substantially react with the acrylic resin.

The disclosures of all the above-mentioned references are incorporated herein by reference.

SUMMARY OF THE INVENTION

An aspect of some embodiments of the present invention concerns a liquid developer having improved cohesion and adhesion. Interestingly, improving cohesion is many times accompanied by compromising adhesion and vice versa, because attraction between the constituents of the developer is improved at the expense of the attraction between theses same constituents and the substrate.

According to some embodiments of the invention, the simultaneous improvement of adhesion and cohesion is achieved by incorporating in the toner particles a pigment, a thermoplastic resin, and an organic reactive filler. Preferably, the organic reactive filler has two characteristics: (1) it is reactive with the thermoplastic resin; and (2) it is incompatible with the liquid carrier. Optionally, the reactive filler is an impact-grindable brittle elastomer that grinds under conditions under which the thermoplastic resin is not grindable. In some embodiments of the invention, the reactive filler cross-links the resin, and therefore, it is sometimes referred below as a polymeric cross-linker.

In the context of the present application, a filler is a particulate substance which does not soften or melt at the fusing temperature, at which fusing of the developer to the substrate takes place during printing. In an embodiment of the invention, the filler is a thermoplastic material having a softening point and a melting point that are higher than the fusing temperature. Optionally, the thermoplastic filler is styrene maleic anhydride.

Examples of organic reactive cross-linkers that are suitable for use in accordance with embodiments of the invention, are styrene maleic anhydride copolymer (hereinafter SMA) and poly-anhydride.

In experiments described below, increasing the amount of the cross-linker improved both adhesion and cohesion in the range of between 0 and 20% reactive filler. It is possible that adding further amounts of the reactive filler would improve these properties even more; however, it is not clear if this would not adversely affect other characteristics of the toner.

Accordingly, in some embodiments of the invention, the polymeric cross-linker constitutes, for instance, 1%, 2%, 5%, 10%, 20%, or any higher or intermediate amount of the toner particle, by weight.

In some embodiments, the toner particles are prepared by grinding together the polymeric cross-linker, the thermoplastic resin and the pigment in the presence of a liquid. Optionally, the liquid is the liquid carrier of the developer.

An aspect of some embodiments of the invention is a method for preparing toner particles for a liquid developer. According to one embodiment of the invention, the method comprises grinding together a polymeric cross-linker as described above with the pigment and the thermoplastic resin in the presence of the liquid carrier of the developer.

An aspect of some embodiments of the invention concerns a substrate printed by liquid electrography with an image having improved adhesion and cohesion. In embodiments of the invention, such a substrate is printed with a developer according to the invention.

There is thus provided, in accordance with an embodiment of the invention, a liquid developer for electrography, comprising toner particles dispersed in a liquid carrier, wherein the toner particles include a pigment, a thermoplastic resin, and an organic reactive filler, which organic reactive filler is reactive with groups of the thermoplastic resin and incompatible with the liquid carrier. Optionally, the solubility of the reactive filler in the liquid carrier is at most 1% at room temperature. In an exemplary embodiment of the invention, the reactive filler is incapable of absorbing an amount of the liquid carrier, which makes more than 3% of the weight of the reactive filler, at room temperature.

There is also provided, in accordance with an embodiment of the invention, a method for preparing a liquid developer, the method comprising grinding together a pigment, a thermoplastic resin, and a reactive organic filler in an aliphatic liquid to obtain a toner concentrate, and adding to the concentrate an aliphatic liquid and a charge director.

In an exemplary embodiment of the invention, the thermoplastic resin is cross-linked by the reactive filler.

Optionally, the liquid carrier comprises an aliphatic liquid, for example, ISOPAR-L.

Optionally, the organic filler is a thermoplastic substance, having softening point and melting point that are higher than a fusing temperature, at which the developer is fused to a substrate during printing, for example, styrene maleic anhydride copolymer (SMA).

Preferably, the toner particles comprise a polymeric resin with a first functional group, and the reactive filler has a second functional group, capable of reacting with the first functional group. Optionally, the first functional group is an acrylic or methacrylic group, and the second functional group is an anhydride group.

Optionally, the reactive filler constitutes at least about 5% (w/w) of non-volatile solids in the developer. Additionally or alternatively, the reactive filler constitutes at most about 35% (w/w) of non-volatile solids in the developer.

There is further provided, in accordance with an embodiment of the invention, a method for preparing a liquid developer, the method comprising grinding together a pigment, a thermoplastic resin, and a reactive organic filler in an aliphatic liquid to obtain a toner concentrate, and adding to the concentrate an aliphatic liquid and a charge director.

Optionally, the reactive filler is a thermoplastic substance, having softening point and melting point that are higher than a fusing temperature, at which the developer is fused to a substrate during printing.

There is further provided, in accordance with an embodiment of the invention, a substrate, carrying an image comprising a thermoplastic resin cross-linked with a cross-linker selected from styrene maleic anhydride copolymer and polyanhydride.

Preferably, the cross-linker is styrene maleic anhydride copolymer.

Optionally, the substrate is printed with a liquid developer disclosed herein and/or is prepared as disclosed herein.

There is also provided, in according with an embodiment of the invention, a method of printing an image on a substrate comprising printing the image using a liquid developer as disclosed herein or prepared according to a method disclosed herein.

BRIEF DESCRIPTION OF FIGURES

Exemplary embodiments of the present invention are described below with reference to figures attached hereto and listed below. Dimensions of components and features shown in the figures are chosen for convenience and clarity of presentation and are not necessarily shown to scale.

DETAILED DESCRIPTION OF EXEMPLARY EMBODIMENTS

Figure 1:
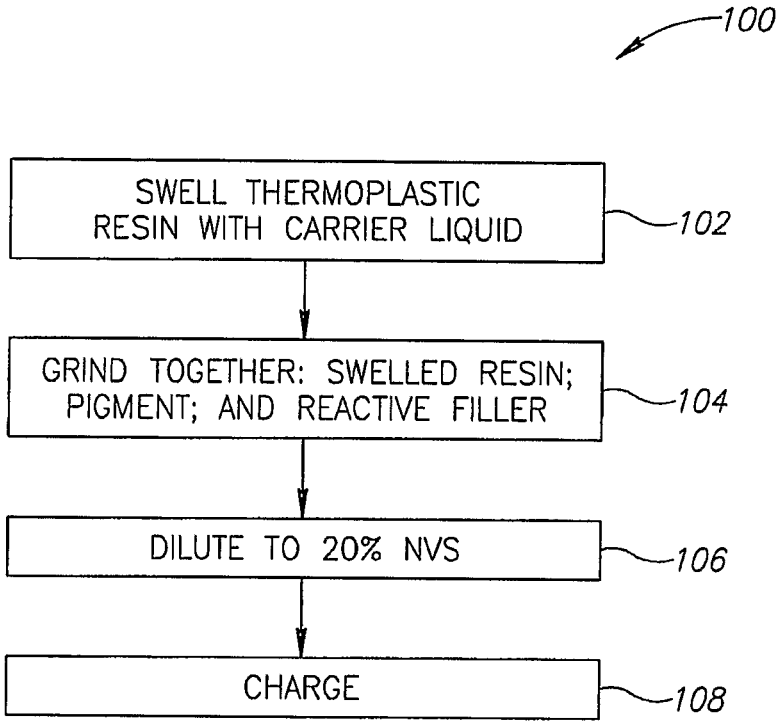
FIG. 1 is a flow chart of a method for preparing a developer according to an embodiment of the invention.

An aspect of some embodiments of the invention relates to a liquid developer that includes toner particles suspended in a liquid carrier, for example, an aliphatic liquid such as Isopar-L. The particles comprise a pigment, a thermoplastic resin, and an organic reactive filler, which is incompatible with the liquid carrier.

Being "incompatible" with the liquid carrier means having solubility of less than 1% in the liquid carrier, and ability to absorb the liquid carrier in amounts that are not larger than 3% by weight of the incompatible material.

Examples of polymeric cross-linkers in accordance with embodiments of the present invention are SMA 1440 by Sartomer, U.S.A and Additol P791 by Cytec.

Incompatibility of an additive with the liquid carrier may be demonstrated, for instance, by low solubility therein and/or by low swelling of the additive in the liquid carrier.

Low solubility means that less than some limit weight, such as 1, 0.1, or 0.05 g, of additive may be dissolved in 100 g of the carrier liquid at room temperature. In the present application, room temperature is about 25° C.

Low swelling means that the additive absorbs only small amounts of the carrier liquid when immersed therein. For instance, 1 g of additive absorbs less than 10 mg of carrier.

Solubility and swelling tests and their results are provided below for two preferred reactive fillers: SMA and polyanhydride.

To measure swellability and solubility of an additive in ISOPAR™ L, two vials are loaded each with 3 g of thermoplastic resin and 12 g of Isopar L. Exact weights of the empty vials and the resin put in them are recorded as Wv and Wi, respectively. The two vials are tightly closed, and heated in an oven at T=45° C. for 18 hours. Then, one of the vials is left for 30 minutes at room temperature, and the other one for a week, with bi-daily shaking.

The supernatant of the first vial is transferred to a third vial, and the liquid residue left in the first vial is removed by squeezing with filter paper or tissue. This vial is then weighted, and its weight recorded as Wvf.

The swelling percentage is calculated using the formula ((Wvf−Wv−Wi)/Wi)*100.

The supernatant from the second vial is filtered through a 0.45 μm filter, and the percentage of soluble resin in the filtered supernatant is measured in a Moisture Analyzer.

In accordance with some embodiments of the invention, a material is considered insoluble in (and thus also incompatible with) the liquid carrier, if there is less than 0.5% carrier in the filtered supernatant. In others, it is considered insoluble if the percentage is less than 1%.

Results of Swelling and Solubility Tests in Isopar

| | % Swelling | | | % Solubility |
|---|---|---|---|---|
| Material | Wi | Wf | 18 hr@45° C. | 18 hrs@45° C. |
| SMA | 3.077 | 3.118 | 1.3% | 0.06% |
| Polyanhydride | 3.002 | 3.046 | 1.5% | 0.04% |

As mentioned above, substrates printed with liquid developers according to some embodiments of the present invention exhibit improved cohesion, adhesion, and faster drying. In practice, improved cohesion and drying speed are expressed by less flaking, and improved adhesion is expressed by lower peeling.

FIG. 1 is a flow chart of a method (100) for preparing a liquid developer according to an embodiment of the present invention.

First (102), 750 grams of polyethylene-acrylic acid copolymer (Nucrel 699, DuPont) as a thermoplastic polymer is mixed in a Ross double planetary mixer with 1750 grams of Isopar L (an iso-parfinic oil manufactured by EXXON) carrier liquid at a speed of 60 μm and a temperature of 130° C. for one hour. The temperature is then reduced and mixing is continued until the mixture reaches room temperature. During mixing the polymer solvates the Isopar and during the cooling granules of polymer (with solvated carrier liquid) in carrier liquid are produced.

Then (104), 1500 grams of the mixture produced in the first step are charged into a Union Process 1S ball attritor together with 12 grams of aluminum tri-stearate (Riedel de-Haan) as a charge adjuvant, 120 grams of styrene maleic anhydride copolymer as a reactive filler, 70 grams of pigment blue 15:3 pigment (Toyo Ink), and 700 more grams of Isopar L. The mixture is ground for 2 hours at 55° C. followed by grinding for 10 hours at 40° C. until a toner concentrate having toner particles incorporating the adjuvant pigments and the filler is produced.

The percentage of thermoplastic polymer and the reactive filler together is about 70% (60%-85%), the percentage of aluminum tri-stearate is about 2% (1%-3%), the percentage of the reactive filler is about 20% (5%-35%) and the percentage of pigment is about 12% (10%-20%) all by weight of the NVS.

Then (106) the mixture is diluted to obtain a concentrate with about 20% NVS.

Then (108), this toner concentrate is charged utilizing 1.5 mg/g of charge director to NVS of toner particles and, optionally, further diluted with additional Isopar L and Marcol 82 (EXXON) to produce a toner having a 2% NVS, with 98% of the carrier liquid being Isopar L and 1% Marcol 82. A commercially available charge director (HP Indigo Imaging Agent 4.0) was used in the experiments. Other charge directors as known in the art can also be used.

The result is a cyan toner. All of the experiments reported below were with cyan toner, although the inventive concepts can be applied to other color, black or, uncolored toners as well.

In practice, toner compositions can vary depending on the characteristics, color, etc. desired, so that in some situations the percentages can vary within (or even outside) the ranges given in parentheses after each percentage component. In addition, the type of polymer used and other components can vary, as known in the art.

The toner obtained as described above with SMA, had a median particle size of about 4 microns, with no measurable amount of particles larger than 20 microns.

When printed with an HP 3000 series, at external heating (EH) mode and blanket surface temperature of 90° C., a print using this toner had an O. D. of 1.40 micrometers and a delta-gloss of −2 units, in comparison to Condat 135 (SBR coated paper). The toner itself had a particle charge of 160 pmho, and dc conductivity of 4.2 pmho.

The toner obtained as described above with polyanhydride instead of SMA had particle size median of about 5 microns, with 5% of the particles being larger than 20 microns. It had a particle charge of 130 pmho, and dc conductivity of 4 pmho. When printed, it had O. D. of 1.40, and delta-gloss (on image paper) of −2 units, in comparison to coated SBR paper.

The two toners, the preparation of which was described above in detail, were used for printing with an HP 3000 series, at external heating (EH) mode and blanket surface temperature of 90° C. on coated semi-acrylic (coated Magnostar 170 g) substrate. The printed images showed better flaking and peeling (in the tests provided below) than a reference ink having the same ingredients but without the cross-linker.

The following table provides detailed results for printing quality tests with a toner prepared with SMA:

| | Flaking | | | | Peeling | | | |
|---|---|---|---|---|---|---|---|---|
| Resin | Flaking BVS 200% | Std. Dev. | Flaking BVS 300% | Std. Dev | Peeling MS | Std. Dev. | Peeling HT | Std. Dev. |
| | 90° C. | | | | | | | |
| Reference F: Ace - no SMA | 3.27 | 1.58 | 60.51 | 17.66 | 21.4 | 2.0 | 12.9 | 1.9 |
| S1_10%_SMA | 0.77 | 0.17 | 42.26 | 2.47 | 17.5 | 3.7 | 8.7 | 0.8 |
| S1_20%_SMA | 0.10 | 0.01 | 1.67 | 2.15 | 6.9 | 0.7 | 2.6 | 0.5 |
| | 110° C. | | | | | | | |
| Reference F: Ace - no SMA | 0.69 | 0.21 | 1.40 | 0.66 | 12.9 | 5.5 | 10.5 | 1.8 |
| S1_10%_SMA | 0.16 | 0.02 | 0.43 | 0.09 | 14.1 | 0.9 | 14.6 | 2.1 |
| S1_20%_SMA | 0.08 | 0.00 | 0.09 | 0.00 | 6.1 | 0.3 | 3.5 | 0.2 |

The reference developer had the same ingredients, but without the SMA, and with more thermoplastic resin, such that the sum of thermoplastic resin and SMA was the same in all samples. The substrates in the experiments were acrylic coated paper (BVS™ by Papierfabrik Scheufelen and Magnostar™ (MS in the table) by Maria Paper SRL, Romania; and non-coated paper Hadar-Top™ by Hadera Paper, Israel.

Flaking was evaluated by printing an image with high coverage (200% and 300%, as mentioned in the table); and 1 minute after printing two printed pages were circularly rubbed one against the other (printed sides facing) for 40 circles. The values given in the table represent the portion of the printed area that appeared white after the circular rubbing.

Peeling was evaluated by printing a 100% image; and 10 minutes after printing, placing on the printed area adhesive tape, and removing it to create damage to the image. Values given in the table represent the portion of the printed area that appeared white after removing the tapes.

Figure 2:
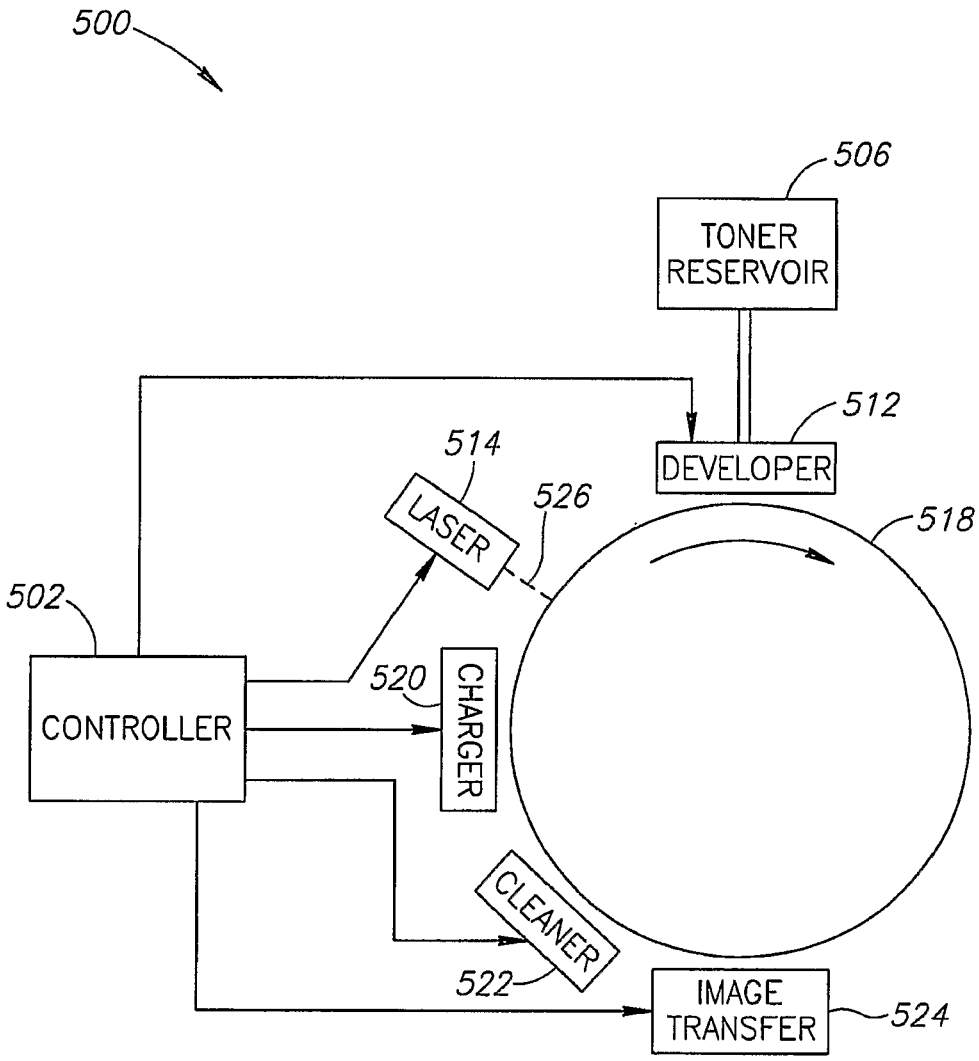
FIG. 2 is a schematic illustration of a printer used to print with a liquid developer, according to some embodiments of the present invention.

FIG. 2 is a schematic diagram demonstrating the relationship of a plurality of elements of a printing apparatus 500, of the kind used to produce prints using a liquid developer with toner particles of the invention. The printing apparatus 500 (which in itself is not new) shown in FIG. 2 is purely schematic to illustrate that the invention can be performed on any liquid toner printer or copier. The toner of the invention can be applied to any system, which transfers toner to a final substrate by one color separation as well as to printing apparatus, which transfer all the separations to an intermediate transfer member and then transfer the group of separations to the final substrate together. Furthermore, the exact mode of development is not important to the practice of the invention, and development can be by binary (layerwise) transfer of high concentration toner or by electrophoretic development using any of the multitude of methods known for bringing the toner into contact with a latent image.

Printing apparatus 500 comprises conventional components such as a photoreceptor imaging cylinder or web 518 having a photoreceptor attached or bonded to it and an axis about which the cylinder rotates and an image transfer section 524 for transferring the developed image to a substrate either directly or via an intermediate transfer member. A charger 520 and a laser unit 514 that provides a scanning laser beam 526 for generating latent images on photoreceptor 518 are used to produce a latent image on the photoreceptor and a developer 512 is used for developing the latent images. Optionally, a cleaning station 522 is used to remove residual toner from photoreceptor 518.

A printing apparatus provided with the elements described with respect to FIG. 2 is useful with liquid developers comprising toner particles described herein. A controller 502 is provided in the printing apparatus in order to issue commands to printing apparatus elements, receive data from printing apparatus elements, process printing apparatus element data, and/or to control printing apparatus operation, in an exemplary embodiment of the invention. Optionally, the printing apparatus includes reservoir tanks for storing printing materials, such as multiple toner reservoirs 506.

The present invention has been described using non-limiting detailed descriptions of embodiments thereof that are provided by way of example and are not intended to limit the scope of the invention. It should be understood that features and/or steps described with respect to one embodiment may be used with other embodiments and that not all embodiments of the invention have all of the features and/or steps shown in a particular figure or described with respect to one of the embodiments. Variations of embodiments described will occur to persons of the art. Furthermore, the terms "comprise," "include," "have" and their conjugates, shall mean, when used in the disclosure and/or claims, "including but not necessarily limited to."

It is noted that some of the above described embodiments may describe the best mode contemplated by the inventors and therefore may include structure, acts or details of structures and acts that may not be essential to the invention and which are described as examples. Structure and acts described herein are replaceable by equivalents, which perform the same function, even if the structure or acts are different, as known in the art. Therefore, the scope of the invention is limited only by the elements and limitations as used in the claims.

The invention claimed is:

1. A liquid developer for electrography, comprising toner particles dispersed in a liquid carrier, wherein the toner particles include a pigment, a thermoplastic resin, and a separate organic filler, which organic filler is reactive with groups of the thermoplastic resin and incompatible with the liquid carrier.

2. A liquid developer according to claim 1, wherein the solubility of the organic filler in the liquid carrier is at most 1% at room temperature.

3. A liquid developer according to claim 1, wherein the organic filler is incapable of absorbing an amount of the liquid carrier, which makes more than 3% of the weight of the organic filler, at room temperature.

4. A liquid developer according to claim 1, wherein the liquid carrier comprises an aliphatic liquid.

5. A liquid developer according to claim 1, wherein the toner particles comprise a polymeric resin with a first functional group, and wherein the organic filler has a second functional group capable of reacting with the first functional group.

6. A liquid developer according to claim 5, wherein the first functional group is an acrylic or methacrylic group, and the second functional group is an anhydride group.

7. A liquid developer according to claim 6, wherein the organic filler is selected from the group consisting of poly-anhydride and styrene maleic anhydride copolymer.

8. A liquid developer for electrography, comprising toner particles dispersed in a liquid carrier, wherein the toner particles include a pigment, a thermoplastic resin, and a separate organic filler, which organic filler is reactive with groups of the thermoplastic resin and incompatible with the liquid carrier, and wherein the organic filler constitutes 5%-35% by weight of non-volatile solids in the developer.

9. A method for preparing the liquid developer of claim 1, the method comprising grinding together the pigment, the thermoplastic resin, and the separate organic filler in aliphatic liquid to obtain a toner concentrate comprising toner particles in liquid carrier, and adding to the concentrate aliphatic liquid and a charge director.

10. A method according to claim 9, wherein the toner particles comprise a thermoplastic resin with a first functional group, and wherein the organic filler has a second functional group, which is reactive with the first functional group.

11. A method according to claim 10, wherein the first functional group is an acrylic or methacrylic group, and the second functional group is an anhydride group.

12. A method according to claim 9, wherein the organic filler is selected from the group consisting of poly-anhydride and styrene maleic anhydride copolymer.

13. A method according to claim 9, wherein grinding is of a mixture comprising solids, at least 5% weight/weight (w/w) of which are formed by the organic filler.

14. A method according to claim 9, wherein grinding is of a mixture comprising solids, at most 35% weight/weight (w/w) of which are formed by the grindable organic filler.

15. A method of printing an image on a substrate comprising printing the image using the liquid developer of claim 1.

* * * * *

UNITED STATES PATENT AND TRADEMARK OFFICE

CERTIFICATE OF CORRECTION

PATENT NO. : 8,940,469 B2
APPLICATION NO. : 12/445459
DATED : January 27, 2015
INVENTOR(S) : Albert Teishev et al.

It is certified that error appears in the above-identified patent and that said Letters Patent is hereby corrected as shown below:

On the title page, in item (75), Inventors, in column 1, line 2, delete "Stalla Stolin Roditi" and insert --Stella Stolin Roditi--;

On the title page, in item (75), Inventors, in column 1, line 2, delete "Rehovot Rehovot" and insert --Rehovot--.

Signed and Sealed this
Fourth Day of August, 2015

Michelle K. Lee

Michelle K. Lee
*Director of the United States Patent and Trademark Office*